US007661480B2

(12) United States Patent
Al-Anazi

(10) Patent No.: US 7,661,480 B2
(45) Date of Patent: Feb. 16, 2010

(54) METHOD FOR HYDRAULIC RUPTURING OF DOWNHOLE GLASS DISC

(75) Inventor: Ammal F. Al-Anazi, Al-Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 133 days.

(21) Appl. No.: 12/080,551

(22) Filed: Apr. 2, 2008

(65) Prior Publication Data

US 2009/0250226 A1 Oct. 8, 2009

(51) Int. Cl.
*E21B 29/00* (2006.01)
*E21B 19/00* (2006.01)

(52) U.S. Cl. ..... 166/376; 166/377

(58) Field of Classification Search ..... 166/376, 166/377

See application file for complete search history.

(56) References Cited

U.S. PATENT DOCUMENTS 3,831,680 A * 8/1974 Edwards et al. ..... 166/311
5,170,844 A 12/1992 George et al.
5,271,465 A 12/1993 Schmidt et al.
5,831,680 A 11/1998 Azuma et al.
5,954,135 A 9/1999 Williamson et al.
5,996,696 A 12/1999 Jeffree et al.
6,186,227 B1 2/2001 Vaynshteyn et al.
6,220,363 B1 4/2001 Dallas
6,315,050 B2 11/2001 Vaynshteyn et al.
6,386,289 B1 5/2002 Patel
6,439,306 B1 8/2002 Patel
6,508,312 B1 1/2003 Latiolais, Jr. et al.
6,561,275 B2 5/2003 Glass et al.
6,564,876 B2 5/2003 Vaynshteyn et al.
6,591,913 B2 7/2003 Reaux et al.
6,591,915 B2 7/2003 Burris et al.
6,752,212 B2 6/2004 Burris et al.
6,823,942 B1 11/2004 McGee
6,920,925 B2 7/2005 Duhn et al.
6,945,331 B2 9/2005 Patel
6,988,553 B2 1/2006 DeBerry
7,025,146 B2 4/2006 King et al.
2005/0028975 A1 2/2005 Al-Muraikhi
2007/0062690 A1 * 3/2007 Witcher ..... 166/222

* cited by examiner

*Primary Examiner*—Jennifer H Gay
*Assistant Examiner*—Yong-Suk Ro
(74) *Attorney, Agent, or Firm*—Abelman, Frayne & Schwab

(57) ABSTRACT

A method for rupturing a glass disc in a well completion tool located downhole in a section of production tubing includes providing a wellhead isolation tool, or tree saver, to isolate the wellhead Christmas tree, adding a pressurized fluid to the tubing/casing annulus and pumping a disc rupturing fluid into the production tubing via the tree saver until the disc is ruptured. Following rupture, the pump can be rapidly stopped, or slowed, and started to create a water hammer effect that removes any glass shards remaining in the disc holder.

14 Claims, 4 Drawing Sheets

PUMP
Diesel tank
Water tank
64
62
60
66
68
66
70
72
80
74
20
30
31
32
50
52
25

METHOD FOR HYDRAULIC RUPTURING OF DOWNHOLE GLASS DISC

FIELD OF THE INVENTION

The present invention relates to a method for rupturing a downhole glass disc positioned in a downhole production tubing of a well.

BACKGROUND OF THE INVENTION

A glass disc is installed in the production tubing prior to completion of horizontally drilled oil and gas wells as a means to temporarily isolate areas having different pressures during testing and completion of the well. The glass disc is an obstruction to hydraulic communication with a reservoir of oil or gas after the completion of the well. Completion requires that the glass disc be removed in order to begin production of hydrocarbons from the reservoir.

Christmas trees and wellhead isolation tools, the latter commonly known as tree savers are used at the end of the tubing string at the earth's surface to control the produced hydrocarbons and the fluids introduced into the wellbore. The pressure ratings for tubing used to seal and control fluid flow to and from a well varies from one manufacturer to another. Tubing is rated for both its burst pressure and collapse pressure. A typical oil production tubing can have a burst pressure rating of 8430 psi and collapse pressure rating of 7500 psi.

Christmas trees constructed of a series of pipes and valves are located on the wellhead after the drilling of the well has been completed. Christmas trees are not designed to withstand the high pressures generated in pumping operations. This limitation serves as a restriction on the hydraulic pressure that can be applied to rupture the glass disc positioned downhole on the production tubing.

Various mechanical and hydraulic devices have been used to provide a means for rupturing the glass discs used to temporarily seal the end or a section of tubing. However, the devices known to the art are complex in construction and require various special tools and lines, can require significant time for set-up and may not fracture the disc on the first try.

It is therefore an object of the present invention to provide an improved method for rupturing a glass disc positioned in a section of production tubing in a well that is reliable and simple to perform, provides a clear indication that the disc has been removed and that does not involve complex downhole apparatus and controls.

It is another object of the present invention to provide a method to rupture a glass disc positioned in a well for isolation of areas having different pressures while protecting the wellhead Christmas tree and production tubing from the higher and potentially damaging pressure used in the rupturing process.

SUMMARY OF THE INVENTION

The above objects, as well as other advantages described herein, are achieved by providing the improved method of the invention for rupturing a glass disc in a production tubing of a well to which a Christmas tree is attached by (1) installing a wellhead isolation tool, or tree saver to isolate the wellhead Christmas tree, and (2) simultaneously pressurizing the annulus between the casing and production strings while the fluid in the production tubing is pumped to the rupturing pressure.

Tool stems are extended down below a tubing hanger of the wellhead during the application of the high pumping pressure. A predetermined minimum pressure is maintained in the tubing/casing annulus during the pumping operation.

A high pumping pressure is applied to the production tubing in the well to rupture the glass disc with the tree saver rigged up to isolate the Christmas tree from the high disc rupturing pressure. The rupturing of the disc is indicated by a sudden drop in pressure.

In a preferred embodiment, fluid injections into the well are alternately rapidly started and stopped after the disc is ruptured in order to produce a water hammer effect to flush out any glass shards that remain in the disc holder.

The pumping is shut down after the rupturing, and optional cleaning of the glass disc. The tree saver is released and the tubing/casing annulus (TCA) pressure is bled off.

The estimated line pressure required to rupture the glass disc can be calculated by the following equation:

$$\text{Pressure to be applied at the wellhead} = \text{Reservoir pressure at the glass disc} + \Delta P - \text{Hydrostatic pressure exerted by the wellbore completion fluid from the top,} \quad (1)$$

where $\Delta P$ is the average hydrostatic pressure at which the same type of glass disc is ruptured in a laboratory simulation.

BRIEF DESCRIPTION OF THE DRAWINGS

The present invention will be further described in conjunction with the accompanying drawings in which.

Figure 1:
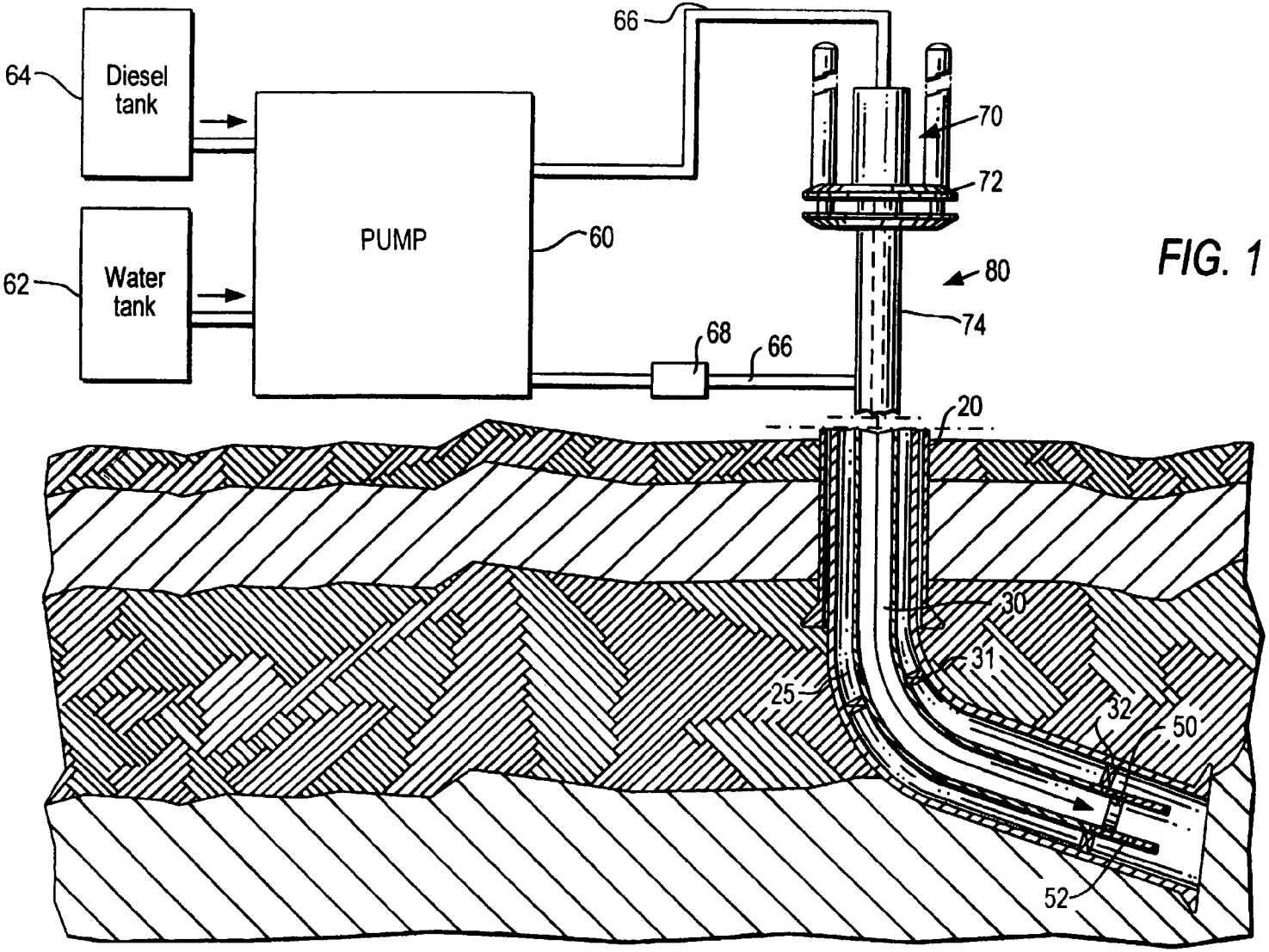
FIG. 1 is a schematic illustration of a glass disc and holder positioned in a partially completed well and related apparatus for the practice of the invention.

To facilitate an understanding of the invention, the same reference numerals have been used, when appropriate, to designate the same or similar elements that are common to the figures. Unless stated otherwise, the features shown and described in the figures are not drawn to scale, but are for illustrative purposes only.

DETAILED DESCRIPTION OF THE INVENTION

The present invention broadly comprehends a method for rupturing a glass disc positioned in a downhole of a well by the controlled application of pressurized liquids to the tubing string above the disc and to the tubing/casing annulus (TCA).

Referring to FIG. 1, the glass disc (50) fitted in its holder (52) is positioned in a downhole section of production tubing (30) positioned in a casing (20) in a well (10) to isolate the downstream portion of the tubing from the reservoir pressure. Thus, these sections will have different pressures $P_1$ and $P_2$, respectively, during completion or testing of the well. After the completion or testing of the well, the glass disc (50) has to be removed to initiate production of oil and/or gas from the reservoir.

As also shown in FIG. 1, casing (20) extends through wellbore (10) and surrounds tubing (30) to form the tubing/casing annulus (25). A seal (32) is positioned in annulus (25) proximate disc holder (50) so that the TCA can be pressurized.

At the wellhead, a pump (60) is attached via conduits (66) to the tree saver (70) positioned above the Christmas tree (80) with appropriate fittings, gages and controls, referred to generally as (90). A second line (66) from the pump (60) is attached to the lower portion of the Christmas tree (80) and flow is controlled by isolation valve (68).

The pressure to be applied for rupturing the glass disc (50) is determined by consideration of the oil or gas reservoir pressure $P_2$ on the upstream side of the disc and the hydrostatic pressure $P_1$ exerted by the wellbore completion fluid from the top of the well. In order to rupture the disc, it is necessary to increase the differential hydrostatic pressure $P_3$ to the failure point of the glass disc.

A laboratory bench test is used to determine the differential pressure that must be applied in the field under various conditions. After the rupturing pressure applied in the laboratory is empirically determined, the estimated pressure to be applied at the wellhead can be calculated in accordance with equation (1) above.

Laboratory Test

Figure 2:
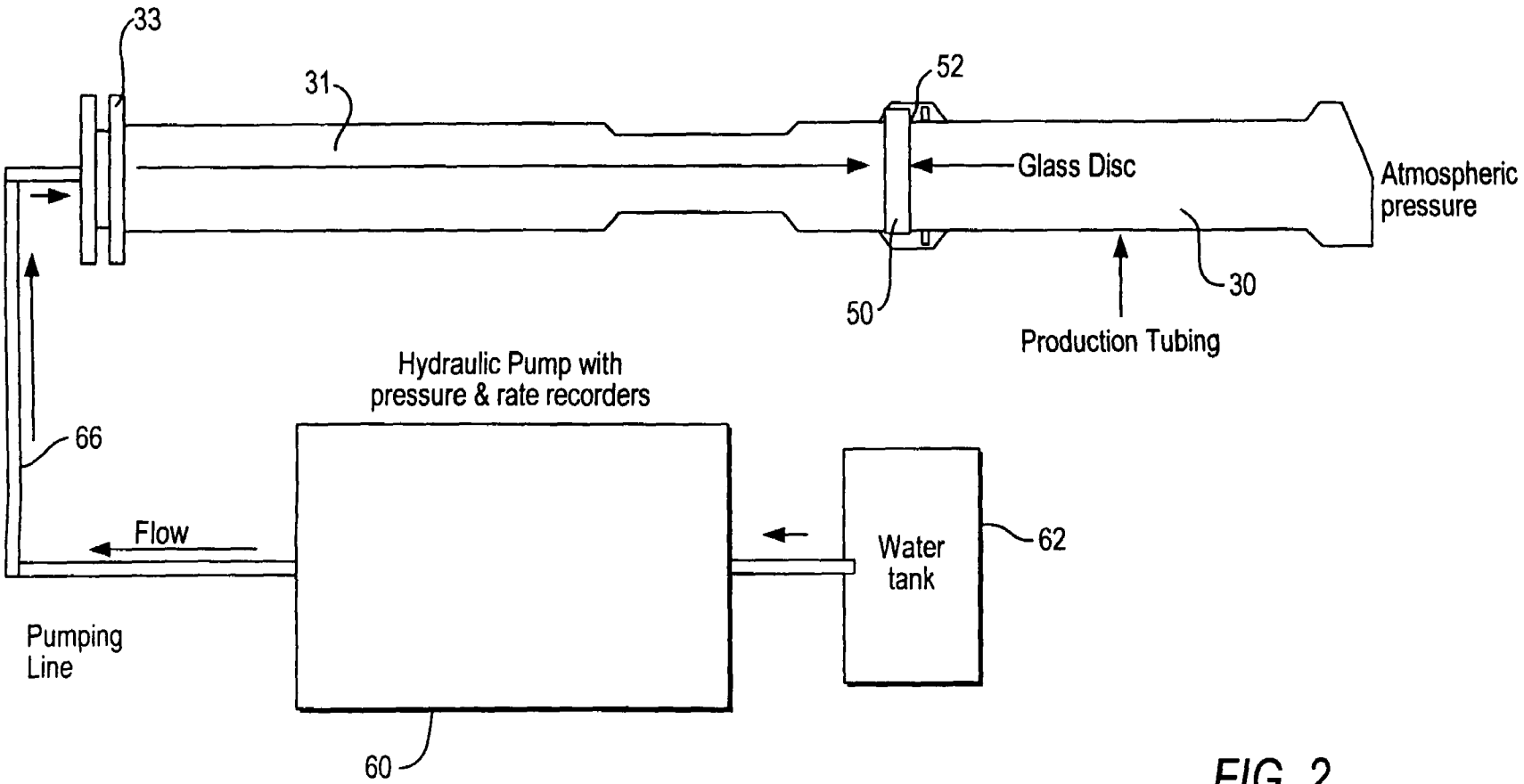
FIG. 2 is a schematic illustration of a completion tool incorporating a glass disc for a laboratory rupture test.

A laboratory test was carried out using the same completion tool incorporating the glass disc (50) as used in field installation at a well. The setup of FIG. 2 shows a completion tool that incorporates the glass disc to be ruptured hydraulically. The tool was connected at one end to a hydraulic pump (160) and to a perforated tube at the other end where hydraulic fluid could be seen splashing when the glass disc ruptured. The test was monitored via video cameras and controlled from a control room.

Figure 3:
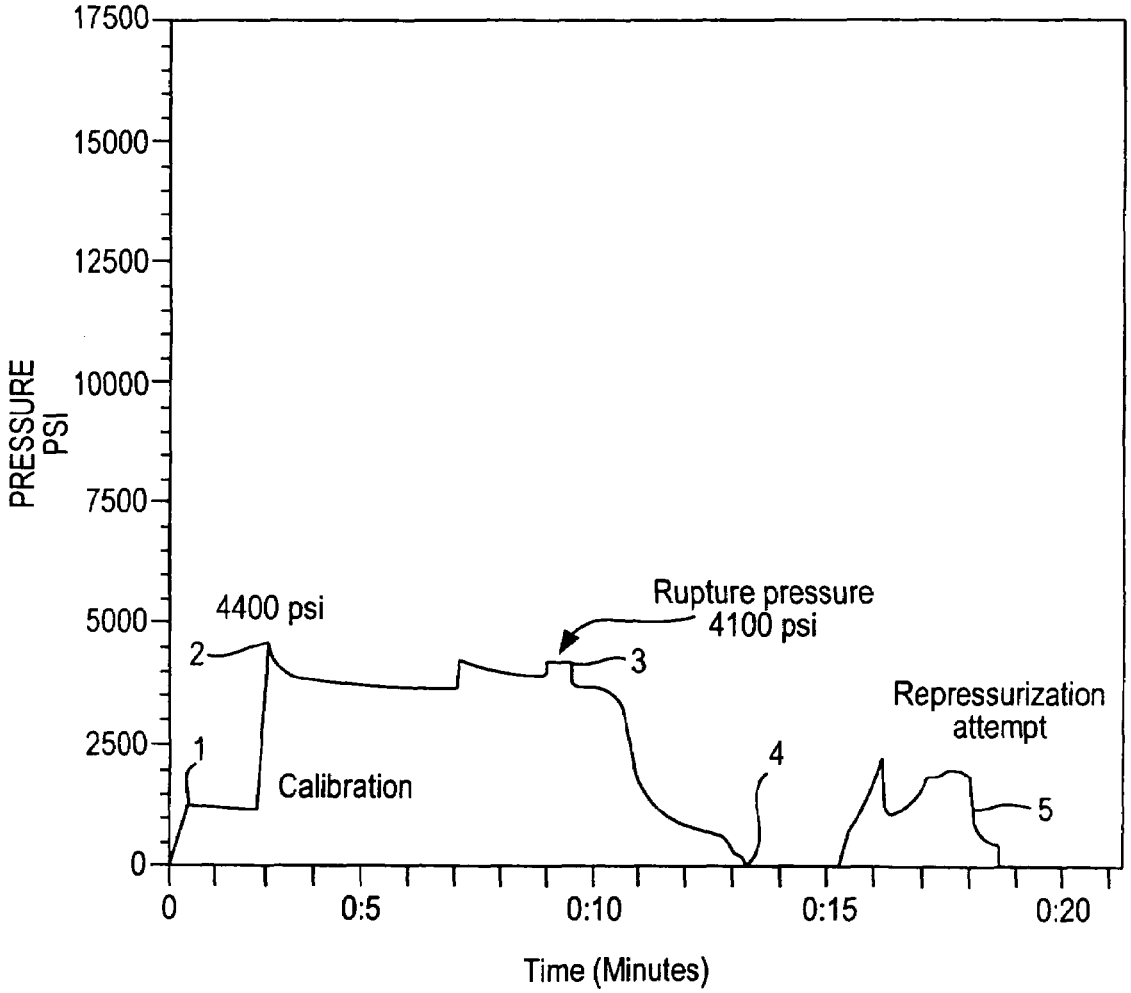
FIG. 3 is a graph showing pressure vs. time during a laboratory disc rupturing test.

The test commenced with the filling of the completion tube with water to ensure an air free system. The pressure was increased to 500 psi to verify that there were no leaks in the system. Referring to the graph of FIG. 3, the gage pressure was increased to 4400 psi and held for 3.5 minutes during which the pressure stabilized at approximately 3500 psi. The pressure was then increased to 4000 psi and stabilized at 3800 psi. These pressure drops can be attributed to microfractures in the disc which allowed a small volume of water to pass from the high pressure side. Next, the pressure was gradually increased until the rupture occurred at 4100 psi. Water flowing out of the downstream perforated tube was observed. Micro-fractures may have initiated at the higher initial pressure of 4400 psi, but did not propagate as the pressure was declining.

The pressure to rupture glass discs of the type currently used in the field was estimated to be about 4100 psi from the above test using an actual well completion tool. While the pressure to rupture the glass disc was 4100 psi in this laboratory test, it will be understood that the pressure to rupture the glass disc may vary somewhat in the field due to differences in the completion tool and composition of the glass discs. In the practice of the invention, it has been found that such variations are small and of no practical consequence.

The tool was disassembled to observe the failure mode of the glass disc and it was observed that the failure was catastrophic indicating a typical brittle failure in which the disc shattered into small pieces that could be easily flushed out of the disc holder and pumped to the surface for removal from the production tubing. This failure mode is highly desirable and the same hydraulic fracturing of the glass disc in the field will provide an optimum result.

Field Procedure

A field implementation requires critical parameters to be evaluated to ensure a well-designed field implementation process. To implement the laboratory rupture pressure in a field application in an actual well completion requires determination of the downhole reservoir pressure. In the present example, the differential pressure, ΔP, at which point the glass disc failed in the laboratory is 4100 psi where "the downstream" pressure was atmospheric, i.e. there was no significant hydrostatic pressure portion of the failure pressure. The ΔP in the field will approximate that determined in the lab test, but the downstream pressure will be substantial. Therefore, the anticipated failure pressure in the field application is calculated as follows:

Pumping pressure to be applied at the wellhead=Reservoir pressure at the glass disc+ $\Delta P$–hydrostatic pressure exerted by the wellbore completion fluid from the top, (1)

where ΔP is the pressure at which the glass disc was ruptured in the laboratory simulation.

The loading rate used in the laboratory is approximately 12000 psi/min. It will be desirable to duplicate this loading rate in the field. If the surface pressure is calculated to be 5000 psi, then it should take 25 seconds to reach 5000 psi.

After the downhole pressure in the well is determined, the method of applying the rupturing pressure is as follows. A high pressure pump is connected to the tree saver injection valve to start the operation. The downhole tubing completion has a specific burst and collapse pressure rating. Consequently, a minimum pressure has to be maintained on the outside of the tubing, in the tubing/casing annulus (TCA). This is necessary in order to operate within the tubing hydraulic pressure rating limitations, so that the integrity of the tubing will not be adversely affected during the high pressure pumping operation. The pressurizing fluid in the TCA should be compatible with the original completion fluid.

The tree saver is rigged on the wellhead Christmas tree during the pumping operation to isolate the Christmas tree from the high pressure fluid in the production tubing that is applied to rupture the glass disc. The tool stems are extended down below the tubing hanger of the production tubing in order to isolate the Christmas tree. A sealing device, e.g., a rubber-to-metal seal, is installed for the isolation. With this device in place, the greater the pumping pressure that is applied, the more the sealing rubber expands outwardly and the more pressure isolation is achieved.

The following steps describe installation of the tree saver:

a. Bleed off any pressure from above the tubing master valve.
b. Remove the crown valve adaptor flange.
c. Rig up the tree saver to the tubing wellhead.
d. Pressure test connections with water to the maximum pumping pressure required.
e. Open the master valve and stroke the tool into the well and stroke out the tool. Inspect the tree saver tool cups for damage.
f. Stroke the tree saver back into the well.
g. Bleed off pressure to seat cups from the wellhead and leave the choke manifold open to monitor the backside for any pressure build-up.
h. Rig up a 2" diameter injection line to the top of isolation tool and to the TCA with an isolation valve between the two lines.
i. Shut in valves and test surface lines with water to 500 psi more than the required pumping pressure.
j. Hold pressure on treatment lines for 5 minutes with no more than a 50 psi drop in pressure for a satisfactory test.
k. Open the TCA and observe the pressure; if needed, pressurize up the back side with diesel to the predetermined recommended TCA pressure value.
l. Close the isolation valve on the TCA, pressurize the main isolation tool treatment line to the pressure that was observed on the wellhead before work was initiated.
m. Once pressure is equalized, open and secure the tree saver.

Before the start of the pumping operation, the downhole tubing plugs are opened or retrieved.

It is preferable that the pumping pressure be brought up gradually to the glass disc rupturing pressure. Preferably, a total of 5 barrels of diesel oil is pumped to confirm the rupture of the glass disc. The rupture of the glass disc will be indicated by a positive shut-in wellhead pressure resulting from the direct, unobstructed hydraulic communication with the oil reservoir.

A predetermined minimum TCA pressure must be maintained throughout the operation to stay below the tubing rupture pressure rating. The required glass disc rupturing pressure can easily be achieved under a variety of tubing operating pressures, glass disc depths, and hydrostatic pressure and reservoir pressure variation conditions. The present invention thus provides a cost effective, time efficient, simple, and safe way to rupture downhole glass discs.

After the glass disc has been ruptured, the pump is shut down, the tree saver is released and the TCA pressure is bled off. To rig down the tree saver, the tree saver stems are stroked out, both a tubing master and a crown valve are closed and the well is ready to be put on stream.

Although the glass disc is ruptured with many fractures, fragments may remain in place even though fluids are able to pass through. Therefore, it is preferable as a final step in the process to generate a water hammer effect. The water hammer effect is generated by rapid pressurization/depressurization cycles to flush out the splintered pieces of the glass disc and ensure that the full opening in the tool is free of glass shards. The water hammer can be created by generating 2-3 sudden pressurizing cycles in the pressurized system, which are impact pressures created by suddenly starting and/or stopping the fluid injection process.

Different tubing completions, different glass disc setting depths, and different reservoir pressures are all independent design and operational parameters that are readily accounted for by one of ordinary skill in the art in practicing the method of the invention.

Figure 4:
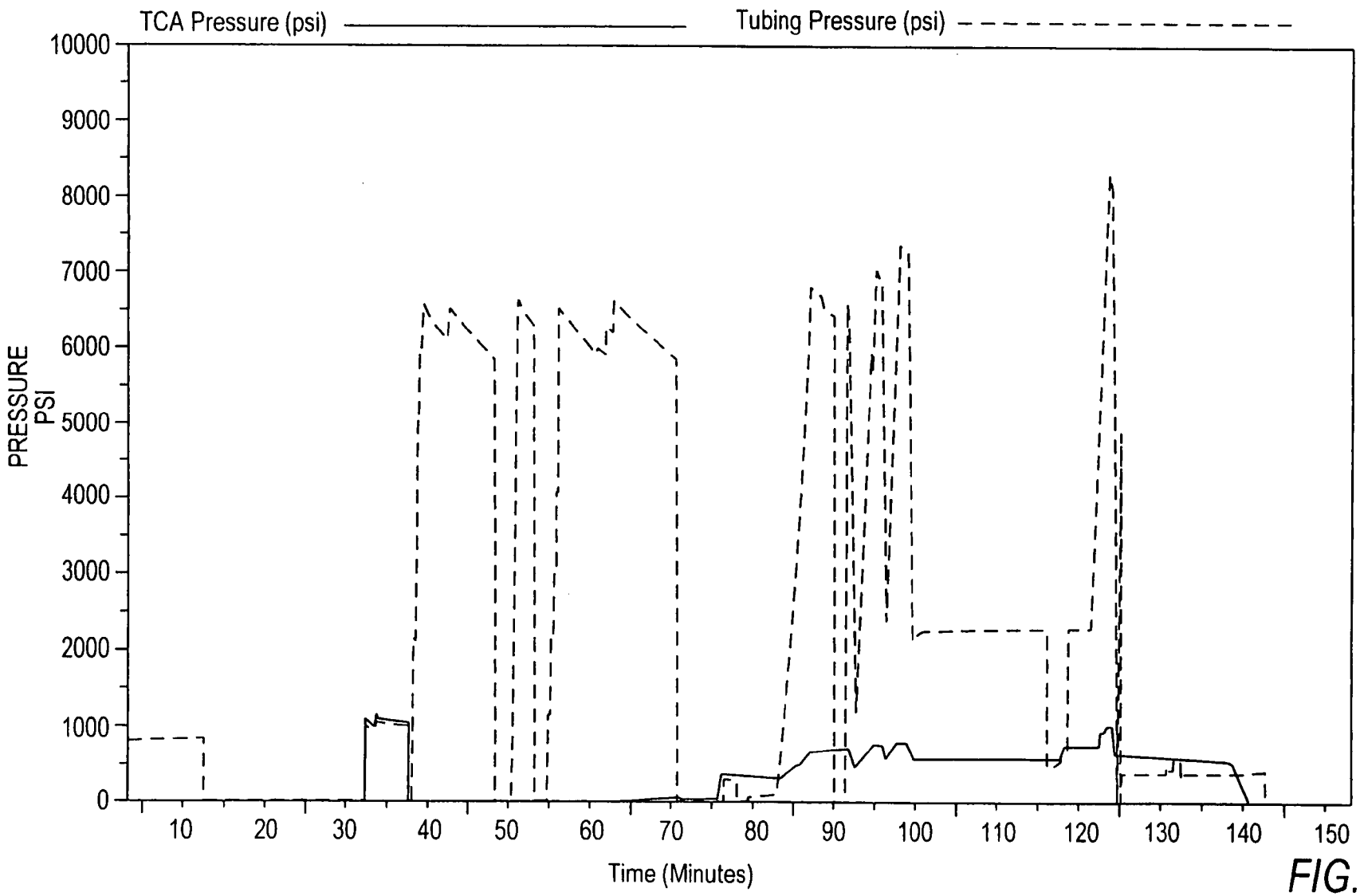
FIG. 4 is a graph showing pressure vs. time for the tubing and TCA lines during an actual field operation.

Referring now to FIG. 4, a graphic plot of the pressure vs. time based on one actual field installation for the practice of the invention will be described. The actual timeline began at 09:24 and ended at 11:06; the representation of FIG. 4 has the timeline reproduced directly in minutes and the pressure plot is in psi. At the commencement, water is introduced into the TCA and pressurized to 1000 psi where it is maintained to identify any leaks. In this case, no leaks were detected. Commencing at 9:34 the tubing is pressurized to 6500 psi and maintained until 10:10 to confirm no leaks; thereafter, the TCA line pressure was bled off to zero and diesel oil was introduced into the TCA to displace the water and pressurized to about 300 psi.

At 10:20 the tubing pressure is increased and the TCA pressure is increased to 850 psi. During the pressurizing of the tubing, the TCA is isolated, but the TCA pressure is monitored in a data acquisition unit in order to assure safe operation. Should the TCA pressure begin to drop significantly, the procedure will be interrupted and tubing pressure reduced until the cause of the fault is determined and corrected. Water rather than diesel was used for pumping to ensure safety since diesel might be subjected to ignition conditions during injection. Injection was started by pressurizing the pump discharge line up to 7500 psi while pressure cycling for three times, i.e., the pressure was increased to 7500 psi and bled off to lower the pressure. The TCA pressure was observed to increase because of the increase in tubing pressure.

By 11:00, the tubing pressure was increased to 8000 psi at the pump discharge and was thereafter bled to 0 in order to initiate a higher differential pressure in the subsequent pressure stroke; the TCA pressure was maintained at about 850 psi. At 11:03 the actual differential line pressure in the tubing reached 2200 psi and the glass disc was ruptured. A decrease in TCA pressure to 670 psi and a sudden increase in injection fluid were noted since the pumping pressure was decreasing. The power to the pump was promptly turned off in order to avoid introducing water into the well. The initial shut-in wellhead pressure after the disc rupture was 412 psi.

At 11:06 the pumping of 5 about barrels of diesel oil at a tubing pressure of 560 psi was commenced in order to insure the removal of any shards of glass in the tool holder. Thereafter, the rupturing operation is deemed completed and the well is ready for production.

The following are examples in which the downhole glass discs on operating wells were ruptured hydraulically utilizing the method of the present invention.

EXAMPLE 1

Well A

A downhole glass disc installed in a section of production tubing in oil well A was successfully ruptured utilizing the tree saver and process of the invention. During the operation, the TCA and the tree saver treatment lines were tested with raw water at pressures of 1000 and 6000 psi for 10 minutes, respectively. The water in the treatment lines was displaced with diesel oil, the TCA was pressurized up to 500 psi, and the isolation valve was closed. Similarly, the tree saver treatment line was gradually pressurized to 5800 psi at which point the glass disc was ruptured as indicated by a volume flow increase of the diesel and a TCA pressure drop. The shut-in wellhead pressure, (SIWHP) was 400 psi and 5 bbls of diesel was injected to confirm the rupture of the glass disc.

EXAMPLE 2

Well B

A downhole glass disc on oil well B was successfully ruptured utilizing the tree saver following the procedure described in Example 1. During the operation, the TCA and the tree saver treatment lines were tested with raw water at pressures of 1000 and 6000 psi for 10 minutes, respectively. The water in the treatment lines was displaced with diesel and the TCA was pressurized up to 300 psi and the isolation valve was closed. Similarly, the tree saver treatment lines were pressured up gradually to 5950 psi at which point the glass disc was ruptured as indicated by a volume increase of the diesel and a TCA pressure drop. The SIWHP was 550 psi and 5 bbls of diesel was injected to confirm the glass disc rupture. FIG. 4 illustrates the pressure test of the tree saver, treatment and TCA lines, as well as the pumping rate and volume, and the glass disc rupturing pressure performance over time. The glass disc was quickly ruptured as soon as the pressure pulse reached the rupturing point.

EXAMPLE 3

Well C

A downhole glass disc on oil well C was successfully ruptured utilizing the tree saver as described above. During the operation, the TCA line and the tree saver treatment lines were tested with raw water at pressures of 1000 and 6000 psi for 10 minutes, respectively. The water in the treatment lines was displaced with diesel and the TCA was pressurized up to 300 psi and the isolation valve was closed. Similarly, the tree saver treatment line was pressurized to 6000 psi. Because of wellbore integrity, the TCA was pressured up to 700 psi and the tree saver treatment lines were gradually pressurized up to 8000 psi, bled to zero and pressurized to 2200 psi at which point the glass disc was ruptured as was indicated by a volume increase in the flow of the diesel and a TCA pressure drop. The SIWHP was 460 psi and 5 bbls of diesel was injected to confirm the disc rupture.

EXAMPLE 4

Well D

The downhole glass disc on oil well D was successfully ruptured utilizing the tree saver as previously described. During the operation, the TCA line and the tree saver treatment lines were tested for 10 minutes with raw water at pressures of 1000 and 7500 psi, respectively. The water in the treatment lines was displaced with diesel oil and the TCA was pressurized to 300 psi and the isolation valve was closed. The tree saver treatment lines were gradually pressurized up to 7700 psi at which point the glass disc was ruptured as indicated by a volume increase of the diesel flow and a TCA pressure drop. The SIWHP was 400 psi and 5 bbls of diesel was injected to confirm the disc's rupture.

The following table summarizes the data from the above examples.

| Well | Surface Injection Pressure (psi) | TCA pressure (psi) | Volume of Diesel Injection (bbl) | SIWHP (Pressure) (psi) |
|---|---|---|---|---|
| A | 5800 | 500 | 12 | 400 |
| B | 5950 | 300 | 10 | 550 |
| C | 2200 | 300-700 | 22 | 460 |
| D | 7700 | 300 | 11 | 460 |

Although various embodiments and examples that incorporate the teachings of the present invention have been shown and described in detail, those of ordinary skill in the art may devise other embodiments that incorporate these teachings, and the scope of the invention is to be determined by the claims that follow.

What is claimed is:

1. A method for rupturing a glass disc during the completion of a well, the glass disc being positioned in a section of downhole production tubing in the well, the tubing being positioned in a casing extending from the wellhead to a position below the production tubing section containing the glass disc, the wellhead being fitted with a Christmas tree for controlling hydrocarbon production, and a wellhead isolation tool attached to the wellhead downstream of the Christmas tree, the method comprising the steps of:

a. adjusting the wellhead isolation tool to isolate the Christmas tree from downhole hydraulic pressure forces;

b. introducing a pressurized rupturing fluid into a section of the production tubing below the wellhead isolation tool that is in communication with the glass disc;

c. introducing a substantially incompressible fluid into the annular space between the production tubing and the surrounding casing; and d. increasing the hydrostatic pressure on the rupturing fluid in the production tubing to a level that is sufficient to rupture the disc while simultaneously maintaining the pressure of the fluid in the annular space at a predetermined value in order to prevent the tubing from rupturing and/or collapsing as a result of the pressure differential.

2. The method of claim 1, further comprising:

e. shutting down pumping after the rupturing of the glass disc;

f. releasing the pressure on the rupturing fluid in the tubing though the wellhead isolation tool; and g. bleeding the tubing/casing annulus pressure.

3. The method of claim 1, wherein tool stems are extended down below a tubing hanger of the wellhead during the application of the pressurized rupturing fluid.

4. The method of claim 1, wherein a predetermined minimum pressure is maintained in the annular space during the pressurizing of step (d).

5. The method of claim 1, wherein the rupturing fluid is pressurized by a high pressure pump connected to the wellhead isolation tool.

6. The method of claim 1, further comprising alternately starting and stopping fluid injections into the tubing to create a water hammer to thereby flush any shards of the glass disc from its holder.

7. The method of claim 2, wherein the pumping pressure at which the glass disc is ruptured is determined by the following equation:

pumping pressure to be applied at the wellhead=reservoir pressure at the glass disc+ $\Delta P$−hydrostatic pressure exerted by the wellbore completion fluid above the disc, (1)

where $\Delta P$ is a differential pressure at which the glass disc is ruptured in a laboratory test.

8. The method of claim 5, which includes the steps of pressure-testing surface connections to the unit with water to the maximum predetermined pumping pressure and displacing the water with a non-aqueous rupturing fluid prior to pressurizing the tubing and the annular space.

9. The method of claim 1, wherein the pressure of the rupturing fluid in the tubing is raised gradually.

10. The method of claim 1 in which the same fluid is used to pressurize the tubing and the annular space.

11. The method of claim 10 in which the fluid is diesel oil.

12. The method of claim 1 in which the maximum value of the pressure maintained in the annular space is less than the pressure required to rupture the disc.

13. The method of claim 12 in which the pressure of the fluid in the annular space is from 300 to 700 psi.

14. The method of claim 1 which includes installing a rubber-to-metal seal to isolate the Christmas tree.

* * * * *